US006316121B1

(12) United States Patent
Maus

(10) Patent No.: US 6,316,121 B1
(45) Date of Patent: Nov. 13, 2001

(54) METAL FOIL WITH THROUGH OPENINGS AND HONEYCOMB BODY

(75) Inventor: Wolfgang Maus, Bergisch Gladbach (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/592,299

(22) Filed: Jun. 12, 2000

Related U.S. Application Data

(63) Continuation of application No. PCT/EP98/07954, filed on Dec. 8, 1998.

(30) Foreign Application Priority Data

Dec. 12, 1997 (DE) ..... 197 55 354

(51) Int. Cl.[7] ..... B32B 3/28; B01J 35/04; F01N 3/28

(52) U.S. Cl. ..... 428/593; 428/596; 428/603; 502/527.18; 502/528.22; 422/180

(58) Field of Search ..... 428/593, 596, 428/597, 600, 603, 604; 502/527.22, 527.18; 422/180

(56) References Cited

U.S. PATENT DOCUMENTS

| | | | | |
|---|---|---|---|---|
| 1,154,254 | * | 9/1915 | Lachman | 428/604 |
| 2,158,929 | * | 5/1939 | Dunajeff | 428/604 |
| 2,481,046 | * | 9/1949 | Scurlock | 428/604 |
| 3,299,598 | * | 1/1967 | Alleaume | 428/604 |
| 4,152,302 | * | 5/1979 | Nonnenmann et al. | 428/593 |
| 4,251,598 | * | 2/1981 | Waite | 428/604 |
| 4,665,051 | * | 5/1987 | Nonnenmann | 502/527.22 |
| 5,045,403 | * | 9/1991 | Maus et al. | 428/593 |
| 5,795,658 | * | 8/1998 | Bode et al. | 428/604 |
| 6,036,926 | * | 3/2000 | Wieres | 422/180 |
| 6,040,064 | * | 3/2000 | Bruck et al. | 428/593 |
| 6,190,784 | * | 2/2001 | Maus et al. | 428/593 |

FOREIGN PATENT DOCUMENTS

| | | |
|---|---|---|
| 38 44 350 A1 | 7/1990 | (DE) . |
| 38 44 350 C2 | 7/1990 | (DE) . |
| 89 09 128 | 1/1991 | (DE) . |
| 43 16 132 A1 | 11/1994 | (DE) . |
| 0 454 712 B1 | 8/1992 | (EP) . |
| 1 491 198 | 11/1977 | (GB) . |

OTHER PUBLICATIONS

International Publication No. WO 96/09892 (Bode et al.), dated Apr. 4, 1996.

* cited by examiner

*Primary Examiner*—John J. Zimmerman
(74) *Attorney, Agent, or Firm*—Herbert L. Lerner; Laurence A. Greenberg; Werner H. Stemer

(57) ABSTRACT

A metal foil includes at least two intersecting structures, which are spaced from an imaginary reference surface and which define an intersection region. The at least two intersecting structures partially superpose one another in the intersection region and are formed with at least one through opening in the intersection region. A honeycomb body includes at least one flat construction formed with channels, which define a flow direction for a fluid to flow through the channels. The at least one flat construction has at least two intersecting structures, which are spaced from an imaginary reference surface and which define an intersection region. The at least two intersecting structures partially superpose one another in the intersection region and have at least one through opening in the intersection region.

25 Claims, 4 Drawing Sheets

METAL FOIL WITH THROUGH OPENINGS AND HONEYCOMB BODY

CROSS-REFERENCE TO RELATED APPLICATION

This application is a continuation of copending International Application No. PCT/EP98/07954, filed Dec. 8, 1998, which designated the United States.

BACKGROUND OF THE INVENTION

Field of the Invention

The invention relates to a flat or sheet-like construction such as a metal foil and to a honeycomb body.

European Patent No. EP-0 454 712 B1, which corresponds to U.S. Pat. No. 5,157,010, describes a flat or sheet-like construction which is formed from a metal sheet or foil. The flat construction has at least two structures which are spaced from a reference surface and which superpose one another at least partially. The mutually superposed structures are in the form of grooves or channels. The structures are of different dimensions. Some of the structures form so-called macrostructures and some of the structures form so-called microstructures. The microstructures overlap the macrostructures. European Patent No. EP-0 454 712 B1 also discloses a honeycomb body having a plurality of passages or channels through which a fluid can flow in a flow direction. The honeycomb body is formed from at least one flat or sheet-like configuration. The passages are defined by the structuring of the flat or sheet-like configuration.

A further configuration of a flat or sheet-like construction which is particularly suitable for forming a honeycomb body is known from International Publication No. WO 96/09892, which corresponds to U.S. Pat. No. 5,795,658. The flat construction has structures which are partially mutually superposed. This flat construction also has macrostructures and microstructures. The microstructures extend at an angle relative to the macrostructures. It can also be seen from International Publication No. WO 96/09892 that the microstructures also cross each other. In particular the microstructures cross at the crests of the macrostructures. The flat construction disclosed in International Publication No. WO 96/09892 is made of a metal sheet or foil in which the structures are formed.

Particularly in the region of the partially overlapping structures which are formed for example by the points of intersection of the microstructures, there are problem zones which result in a heavy loading of the material forming the flat construction, during a procedure for shaping the material.

Due to the deformation characteristics of the metal foil or sheet, it is not possible to guarantee that, in the region of the mutually superposed structures, the transition between the mutually superposed structures is satisfactorily produced. That has an effect in particular on structures which are of relatively large dimensions.

International Publication No. WO 96/09892 also describes a metal honeycomb body having a plurality of passages or channels through which a fluid can flow in a flow direction. The passages are formed of metal foils or sheets which are at least partially provided with at least one macrostructure which defines the passages and which determines the honeycomb form of the metal honeycomb body. A part of the sheet metal portions has at least in partial regions additional microstructures. The microstructures extend at an angle to the flow direction, successive microstructures are spaced from one another, and the microstructures cross each other.

German Patent No. DE 38 44 350 C2 discloses a flat construction which has structures. The structures are limb-shaped or bar-shaped portions which are pressed in a bridge-like shape out of a plane of the flat construction. The limb-shaped or bar-shaped portions are provided side-by-side in longitudinally directed zones extending in mutually parallel relationship. The limb-shaped or bar-shaped portions project towards both sides out of the plane of the metal foil or sheet. The limb-shaped or bar-shaped portions which project on both sides are produced by a procedure in which an initially flat smooth metal strip is passed through a pair of embossing-cutting rollers by which the strip is partially slit and the limb-shaped or bar-shaped portions are pressed out towards both sides of the plane of the strip. A flat construction of that kind has no overlapping structures.

SUMMARY OF THE INVENTION

It is accordingly an object of the invention to provide a flat construction, in particular a metal foil, which overcomes the above-mentioned disadvantages of the heretofore-known constructions of this general type and which is easier to manufacture and process. A further object of the invention is to provide a honeycomb body which is easier to manufacture.

With the foregoing and other objects in view there is provided, in accordance with the invention, a metal foil, including:

at least two intersecting structures spaced from an imaginary reference surface and defining an intersection region; and the at least two intersecting structures partially superposing one another in the intersection region and being formed with at least one through opening in the intersection region.

In other words, the flat construction, in particular a metal foil, according to the invention which has at least two structures which are spaced from a reference surface and which are in mutually superposed relationship is distinguished in that there is at least one through opening formed in a region in which the structures overlie or superpose each other. The structures superpose each other insofar as, for example, they cross each other or meet each other. In those regions, during the manufacturing of the structures, the flat construction is subjected to a particularly heavy loading when the structures are produced by a shaping operation. Furthermore, folds, distortions or the like can occur in the region of the mutually superposed structures. This is avoided by the formation of at least one through opening in the region of the mutually superposed structures.

The formation of structures results in an increased level of stiffness in a flat construction. The provision of through openings in the regions of the mutually superposed structures also provides that the flat construction has a higher degree of flexibility. This achieves an improved further processing of the flat construction.

The through opening is preferably formed by at least one slot. In that respect, a preferred configuration of the through opening is one in which there are at least two slots which meet or intersect at an angle and in particular cross one another. Thus, an optimum utilization of material is achieved.

In order to avoid that portions of the structures possibly project in the region of the through opening, so that such portions cause a nuisance or a disturbance, it is proposed that the through opening is formed by at least one perforation.

The process of forming the at least one through opening in the flat construction or metal foil is preferably performed before the structures are formed. That makes it possible to synchronize the formation of the through openings and the structures so that the through openings are always produced at a predetermined location on the flat construction or metal foil.

Configuring the flat construction or the metal foil in accordance with the invention also permits a superimposition of structures which have a similar geometry, in particular if they form relatively large structures within the flat construction because the through opening removes the possible problem zone, before the shaping procedure is carried out.

In accordance with a further feature of the invention, the at least two intersecting structures superpose one another at a given angle in the intersection region.

In accordance with another concept of the invention, a flat or sheet-like construction or a metal foil is provided which has at least two structures which are spaced from a reference surface and which are disposed in an at least partially mutually superposed relationship. The flat construction has at least one through opening formed in a region in which the mutually superposed structures have a common theoretical maximum height with respect to the reference surface, which is greater than a maximum height of at least one structure in that region. In that case, the entire edge of the through opening is disposed at a level with respect to the reference height that is less than the theoretical maximum height. Preferably, the spacing distance of the edge of the through opening with respect to the reference surface corresponds to the height of the superposed structure. Such a configuration for the flat construction or metal foil provides that, in the region of the mutually superposed structures, the height of the mutually superposed structures is less than the theoretically possible maximum height of the mutually superposed structures so that there are no peaks.

In accordance with a further feature of the invention, the flat construction or the metal foil has structures which are of a substantially wave-shaped configuration. The wave-shaped structures can cross or intersect for example at an angle. Although the flat construction overall can adopt a wave-shaped configuration, that configuration can be wound or coiled due to the through openings within the respective surfaces of the structures. The wave-shaped structures can also meet or intersect at an angle. In this case also, a further processing of the flat construction is simplified due to the provision of the through openings in the superposed region of the structures.

Structures of different cross-sectional geometries can be formed due to the provision of at least one through opening in the overlap region. A preferred configuration of such a structure has a substantially V-shaped cross-section.

Due to the presence of the through openings, it is also possible to form structures which, as viewed in a longitudinal direction of the structure, can be of different geometry and/or configuration, with the through opening being provided between two adjacent different structures.

The structures can also be of such a nature that they have a longitudinal extent, wherein the structures have at least two adjacent longitudinal portions which are directed in opposite relationship substantially perpendicularly to the reference surface. Such a configuration allows a simpler wave-like or corrugation configuration in opposite directions for the flat construction or the metal foil.

In accordance with a further advantageous feature of the invention, a flat construction or metal foil in which at least one structure forms a primary structure and at least one structure forms a secondary structure is provided. The primary structure has a larger amplitude than the secondary structure. The primary structure can be a macrostructure. The secondary structure can be what is called a microstructure.

A preferred embodiment of the flat construction or metal foil has secondary structures disposed in superposed relationship on the primary structures. In particular, the secondary structures are in a superposed relationship on a wave crest or in the wave trough of the primary structures, and in particular cross or intersect one another.

The flat construction preferably includes a metal material. The flat construction can be for example of a mesh-like nature. A preferred construction is formed by a metal sheet or foil.

With the objects of the invention in view there is also provided, a honeycomb body, including:

at least one flat construction formed with channels defining a flow direction for a fluid to flow through the channels;

the at least one flat construction having at least two intersecting structures spaced from an imaginary reference surface and defining an intersection region; and the at least two intersecting structures partially superposing one another in the intersection region and being formed with at least one through opening in the intersection region.

In other words, in accordance with another concept of the invention, there is provided a honeycomb body having a plurality of passages or channels through which a fluid can flow in a flow direction. The honeycomb body is formed by at least one flat construction. The flat construction has at least two structures which are spaced from a reference surface and which are in at least partially superposed relationship.

The at least two structures define or bound the passages. The honeycomb body is distinguished in that at least one through opening is provided in at least one region in which the structures are superposed. The formation of the through opening achieves that the honeycomb body is easier to produce because, where the structures at least partially overlap, the at least one through opening imparts to the flat construction a certain degree of elasticity which makes it possible for example for the honeycomb body to be formed by winding the construction in a spiral configuration. A further advantage of this configuration is that, in the regions in which the structures are in a superposed relationship, the construction is not exposed to an increased mechanical loading during the production of the structures.

Preferably the through opening is formed by at least one slot. Desirably the through openings are formed by a plurality of slots which meet or intersect at an angle and in particular cross one another. The through opening can also be in the form of at least one perforation.

In accordance with a further feature of the invention, a honeycomb body has a plurality of passages or channels through which a fluid can flow in a through-flow direction and which is formed by at least one flat construction having at least two structures which are spaced from a reference surface and which are in a partially superposed relationship. The structures at least partially delimit or bound the passages. The honeycomb body is distinguished in that there is provided at least one through opening disposed in a region in which the mutually superposed structures are of a common theoretical maximum height with respect to the reference surface, which is greater than a height of at least one structure in the region, wherein the through opening has an edge whose spacing relative to the reference surface is smaller than the theoretical maximum height. Such a configuration of the honeycomb body has the advantage that layers of the flat construction lie or rest better against each other because there are no peaks formed by the superposed relationship of the structures, as is for example the case in a configuration shown in International Publication No. WO 96/09892. Particularly when the honeycomb body is in the form of a metal honeycomb body in which the flat constructions are formed by metal foils or sheets, this also allows a simplified brazing of the metal foils or sheets to one another and/or to a metal tube. The through opening also allows connecting the flat constructions by suitable connecting devices, for example pins, with the connecting devices extending through the through openings. Such a connection can of course also be provided for a honeycomb body made from a material other than metal foils or sheets.

Preferably the honeycomb body is formed such that the structures are of a substantially wave-shaped configuration or corrugation configuration. In particular it is proposed that, in a honeycomb body, at least one of the two structures is of a substantially V-shaped cross-section.

In accordance with a further advantageous configuration of the honeycomb body, at least one structure forms a primary structure and at least one structure forms a secondary structure, wherein the primary structure has a larger amplitude than the secondary structure. Preferably the structures are such that the secondary structures are in a superposed relationship on the primary structures. For that purpose it is proposed in particular that the superimposition of the secondary structures is on the wave crests of the primary structures or in the wave troughs of the primary structures.

In that case, the primary structure forms basically a macrostructure while the secondary structure forms a microstructure.

In accordance with a further advantageous feature of the invention, the honeycomb body is formed by alternate layers of smooth and structured constructions or configurations, wherein the structured constructions have a primary structure and possibly a secondary structure. In order to improve the flow dynamics of the honeycomb body, it is further proposed that the honeycomb body is formed by alternate layers of smooth and structured constructions, wherein the smooth constructions have a secondary structure.

In accordance with another feature of the invention, the at least one flat construction of the honeycomb body includes alternating layers of smooth configurations and structured configurations, and the smooth configurations have a primary structure.

Particularly when using the honeycomb body as a catalyst carrier body for exhaust systems of internal combustion engines, it is proposed that the flat construction at least partially includes a metal material. In particular it is proposed that the flat construction is a metal foil or sheet.

Other features which are considered as characteristic for the invention are set forth in the appended claims.

Although the invention is illustrated and described herein as embodied in metal foil with through openings and in a honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
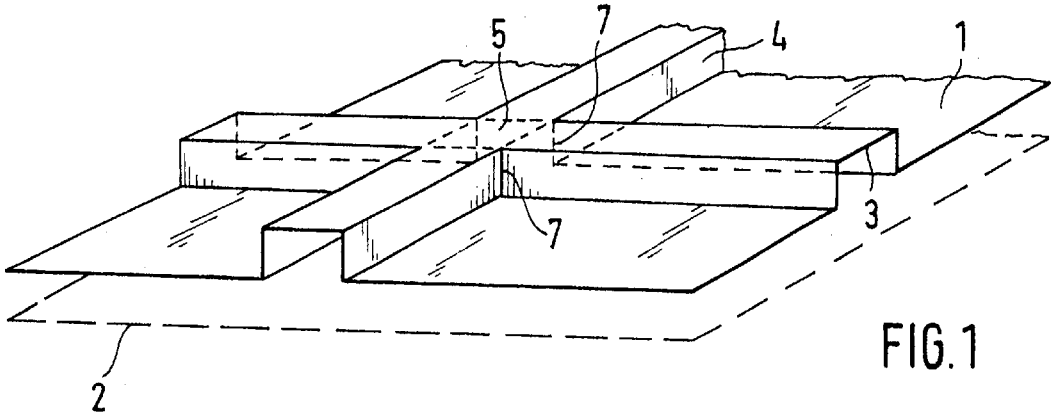
FIG. 1 is a diagrammatic perspective view of a metal foil with structures without a through opening.

Referring now to the figures of the drawings in detail and first, particularly, to FIG. 1 thereof, there is shown a diagrammatic perspective view of a metal foil or sheet 1 with structures 3, 4. The structures 3, 4 are spaced with respect to a reference surface 2. The reference surface 2 is substantially parallel to the metal foil 1 in the unstructured condition. The reference surface 2 is shown in broken line in FIG. 1.

In the illustrated embodiment the structures 3, 4 are of a substantially rectangular cross-section. Other cross-sections are possible. The configuration of the cross-section can be such as to correspond to the requirements made of the metal foil 1.

FIG. 1 shows that the structures 3, 4 are in mutually superposed relationship in a region 5. The region 5 is shown in broken line. To simplify production of the metal foil with the structures 3, 4 and to improve the flexibility of the metal foil 1, it is proposed with the present invention that a through opening, which is not shown in FIG. 1, is formed in the region 5. The through opening is preferably of such a size that it corresponds at least to the region 5 so that the edges 7 between the structures 3, 4 are removed, such that the structures 3, 4 are no longer joined to each other.

Figure 2:
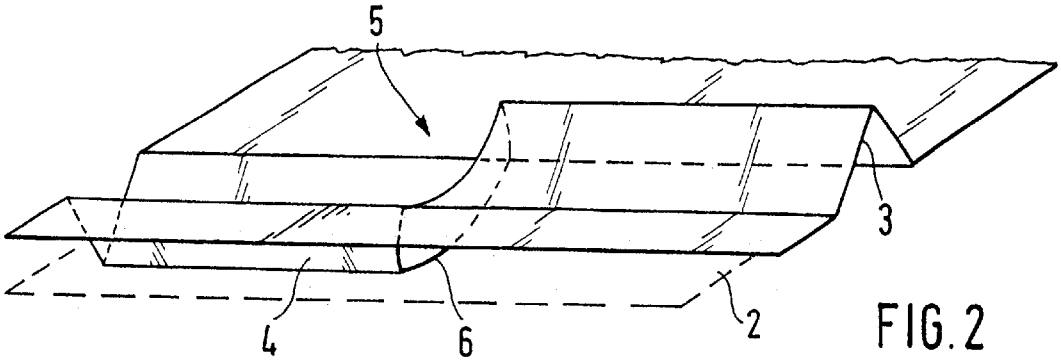
FIG. 2 is a diagrammatic perspective view of a metal foil with structures and with a through opening according to the invention.

FIG. 2 shows a metal foil 1 with structures 3, 4 which are substantially V-shaped in cross-section. The structures have a longitudinal extent. Provided in the region 5, in which the structures 3, 4 would be in a superposed relationship, is a through opening 6, due to which the structures 3, 4 have substantially no common edge.

Figure 3:
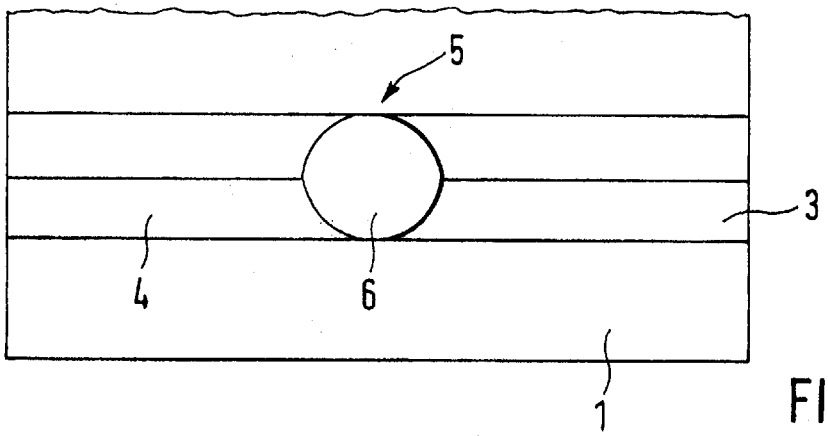
FIG. 3 is a plan view of the metal foil or sheet shown in FIG. 2.

FIG. 3 is a plan view of the metal foil or sheet shown in FIG. 2. A through opening 6 is provided in the metal foil in a region 5 where the V-shaped structures 3, 4 would meet, if there were no through opening 6.

Figure 4:
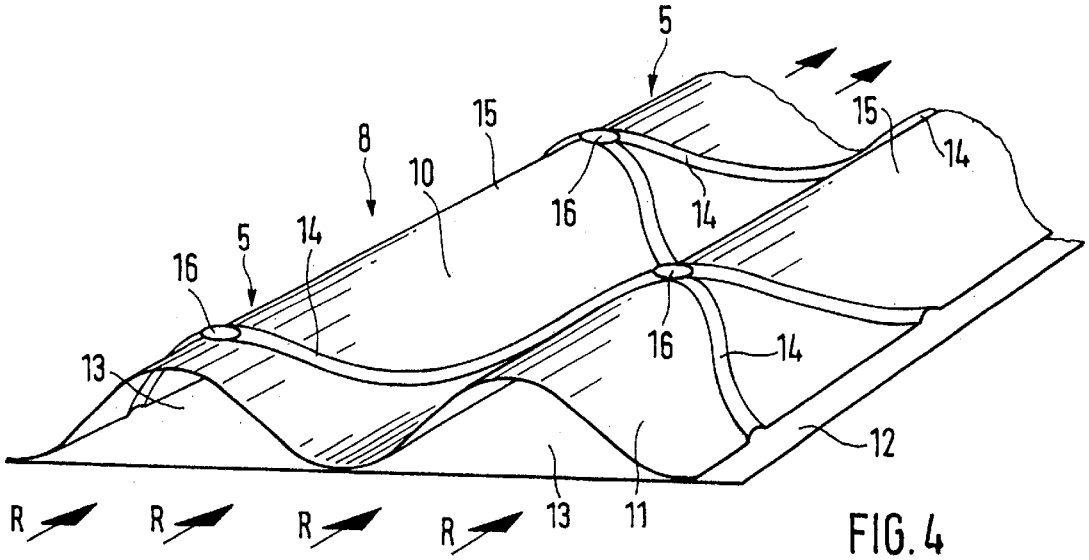
FIG. 4 is a diagrammatic perspective view of a configuration of a metal foil with structures and a smooth sheet.
Figure 5:
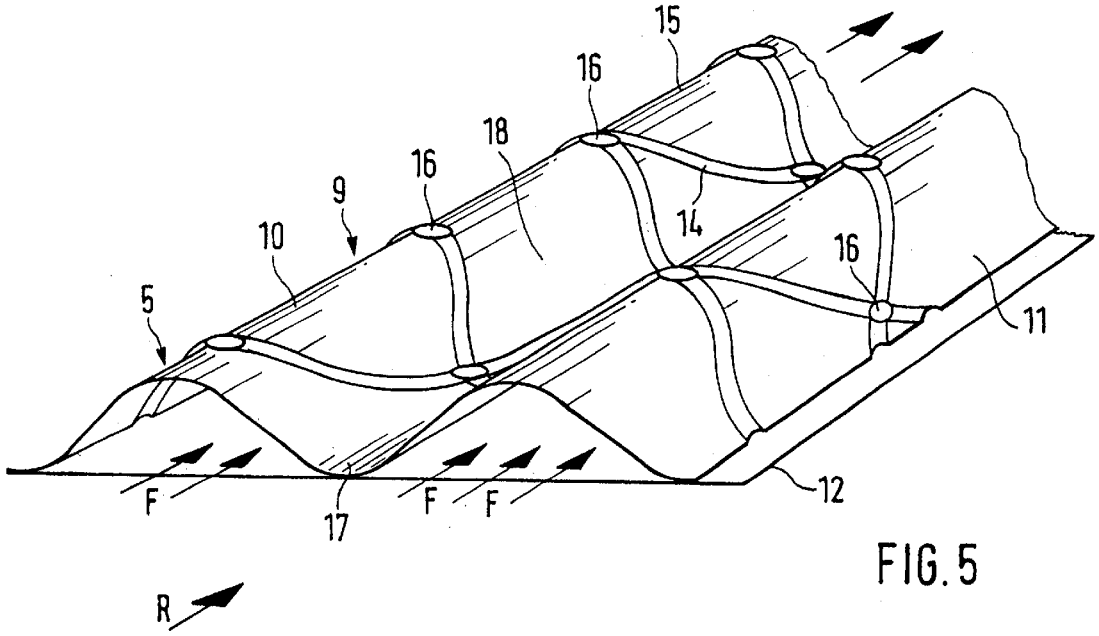
FIG. 5 is a diagrammatic perspective view of a further configuration of a metal foil with structures and a smooth sheet.

The structures illustrated in FIGS. 1 and 2 have cross-sections that are substantially constant. FIGS. 4 and 5 show metal foils 8, 9 having primary structures 10, 11. The structures 10, 11 form a substantially wave-shaped or corrugation-like metal foil 8 and 9 respectively. The structures 10, 11, together with a smooth metal foil or sheet 12, delimit passages 13 through which a fluid flows in the direction R.

The metal foil 8 is also provided with a secondary structure 14. The secondary structure 14 are intersecting, strip-shaped embossings or stampings in the metal foil 8. The amplitude of the secondary structures 14 is less than the amplitude of the primary structures 10, 11. As can be seen from FIG. 4 the secondary structures 14 cross or intersect each other on wave crests 15 of the primary structures 10, 11. Through openings 16 are provided in the region of the crossing locations of the secondary structures 14.

FIG. 5 shows a modification of the configuration shown in FIG. 4 of the structured metal sheet or foil and a smooth metal sheet or foil 12. The metal foil 9 differs from the metal foil 8 shown in FIG. 4, in that the secondary structures 14 cross or intersect not only on the wave crests 15 but also in the wave trough 17 and on the flanks of the primary structures. The mutually crossing secondary structures are formed at an angle with respect to the flow direction R of a fluid F. Respective through openings 16 are provided in the crossing regions or superimposition regions of the secondary structures 14 so that the secondary structures 14 do not have a common connecting edge.

The embodiments and configurations of the metal foils, as are shown in FIGS. 4 and 5, can form a part of a metal honeycomb body.

Figure 6:
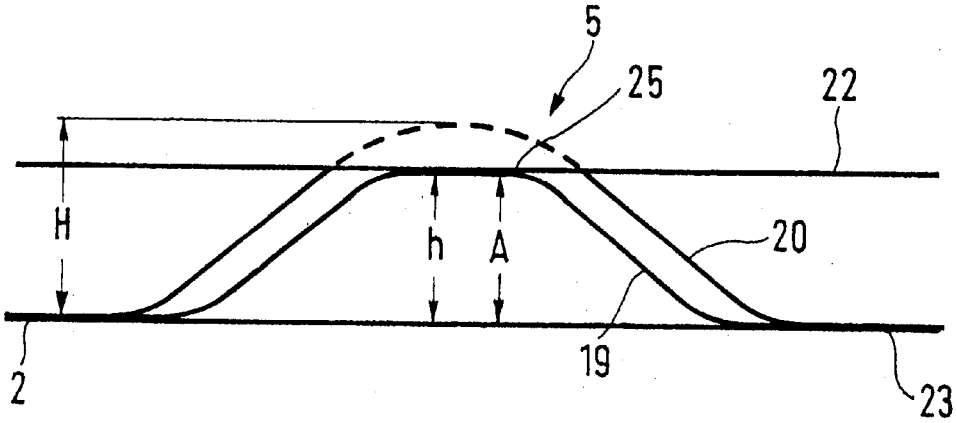
FIG. 6 is a diagrammatic front view of a metal foil with a structure between two smooth sheets.

FIG. 6 shows a configuration of a structured metal foil 21 between two smooth metal foils 22, 23. The structured metal foil 21 has a primary structure 19 and a secondary structure 20 which extends substantially transversely with respect to the longitudinal extent of the primary structure 19. A part of the primary structure 19 and of the secondary structure 20 has been removed by a stamped-out or punched-out portion forming a through opening 24. The configuration of the secondary structure 20 prior to the stamping-out operation is shown in broken line in FIG. 6. The through opening 24 is formed in a region 5 in which the mutually superposed structures 19, 20 are of a common theoretical height H, with respect to a reference surface 2, that is greater than a height h of the structure 19 in the region 5. The through opening 24 has an edge 25. The spacing distance A between the edge 25 and the reference surface 2 is less than the theoretical height H.

In the region 5 of the through opening 24 the metal foil 22 rests on the wall of the primary structure 19 and the secondary structure 20, whereby a good contact is formed between the smooth metal foil 22 and the structured metal foil 21. This contact is suitable in particular for the formation of a brazed or soldered joint between the structured metal foil 21 and the smooth metal foil 22.

Also the configurations of the metal foils 8, 9, which are shown in FIGS. 4 and 5, permit a good connection to be made to a smooth metal foil which is disposed on the metal foils 8, 9.

Figure 7:
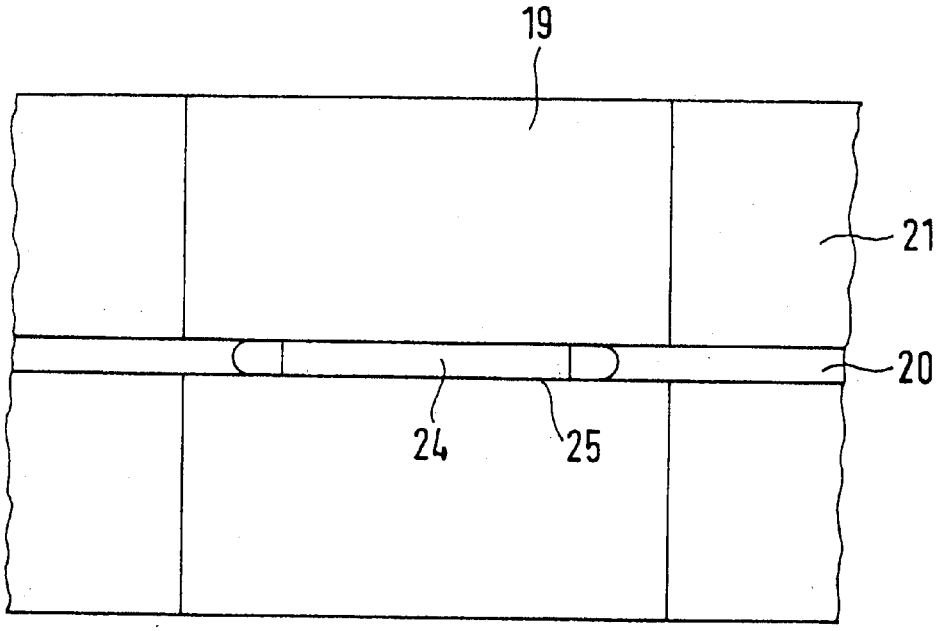
FIG. 7 is a diagrammatic plan view of the metal foil with a structure as shown in FIG. 6.
Figure 8:
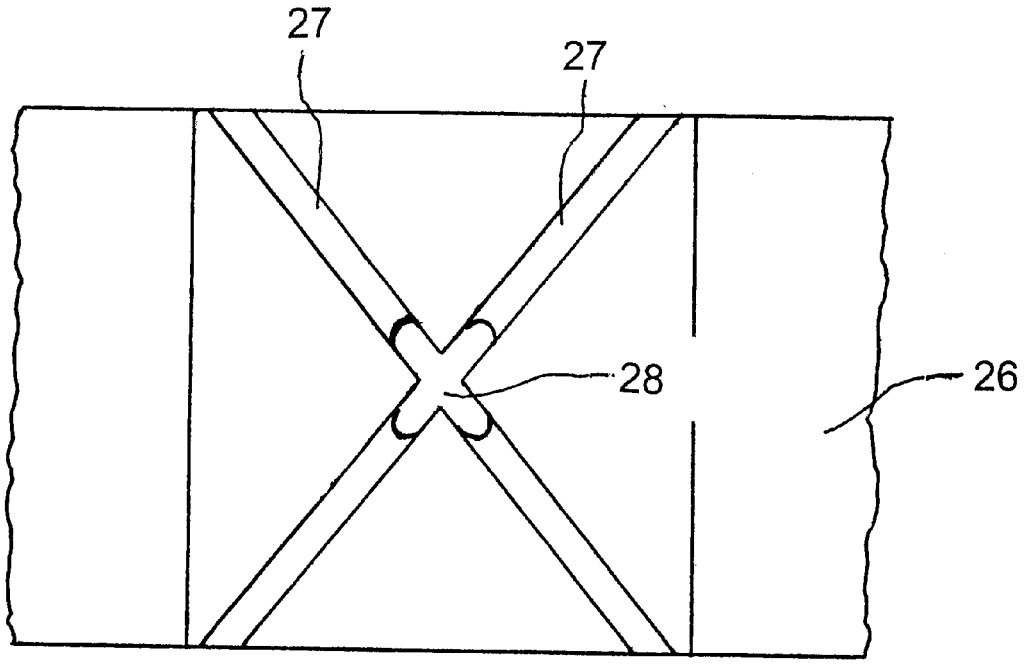
FIG. 8 is a diagrammatic plan view of the metal foil having intersecting slot-shaped through openings.

FIG. 7 is a diagrammatic plan view of a structured metal foil 21 with a primary structure 19 and a secondary structure 20. A through opening 24 with an edge 25 is formed in an intersection region of the structures. FIG. 8 is a diagrammatic plan view of a structured metal foil 26 having secondary structures 27. A through opening 28 in the form of two slots intersecting at a given angle is formed in an intersection region of the structures.

What is claimed is:

1. A metal foil, comprising:

at least two intersecting structures spaced from an imaginary reference surface and defining an intersection region; and said at least two intersecting structures partially superposing one another in said intersection region and being formed with at least one through opening in said intersection region, said at least two intersecting structures having, in said intersection region, respective heights with respect to the imaginary reference surface;

said at least two intersecting structures have, in said intersecting region, a region of a common theoretical maximum height with respect to the imaginary reference surface, the common theoretical maximum height is greater than at least one of the respective heights;

said at least one through opening is provided in said region of the common theoretical maximum height; and said at least one through opening has an edge spaced from the imaginary reference surface by a given spacing distance, the given spacing distance being smaller than the common theoretical maximum height.

2. The metal foil according to claim 1, wherein said at least one through opening is at least one slot.

3. The metal foil according to claim 1, wherein said at least one through opening is a plurality of through openings including at least two slots intersecting at a given angle.

4. The metal foil according to claim 1, wherein said at least one through opening is at least one perforation.

5. The metal foil according to claim 1, wherein said at least two intersecting structures superpose one another at a given angle in said intersection region.

6. The metal foil according to claim 1, wherein said at least two intersecting structures are substantially wave-shaped structures.

7. The metal foil according to claim 6, wherein at least one of said at least two intersecting structures has a substantially V-shaped cross-section.

8. A metal foil comprising:

at least two intersecting structures spaced from an imaginary reference surface and defining an intersection region; and said at least two intersecting structures partially superposing one another in said intersection region and being formed with at least one through opening in said intersection region, at least one of said at least two intersecting structures being a primary structure having a first amplitude and at least one of said at least two intersecting structures being a secondary structure having a second amplitude, and said first amplitude being greater than said second amplitude.

9. A metal foil comprising:

at least two intersecting structures spaced from an imaginary reference surface and defining an intersection region; and said at least two intersecting structures partially superposing one another in said intersection region and being formed with at least one through opening in said intersection region, said at least two intersecting structures being a plurality of structures including a primary structure having a first amplitude and including at least two secondary structures having respective second amplitudes, said first amplitude being greater than said second amplitudes, said primary structure having a wave crest, and said at least two secondary structures superposing one another on said wave crest.

10. A metal foil comprising:

at least two intersecting structures spaced from an imaginary reference surface and defining an intersection region; and said at least two intersecting structures partially superposing one another in said intersection region and being formed with at least one through opening in said intersection region, said at least two intersecting structures being a plurality of structures including a primary structure having a first amplitude and including at least two secondary structures having respective second amplitudes, said first amplitude being greater than said second amplitudes, said primary structure having a wave trough, and said at least two secondary structures superposing one another on said wave trough.

11. A honeycomb body, comprising:

at least one flat construction formed with channels defining a flow direction for a fluid to flow through said channels;

said at least one flat construction having at least two intersecting structures spaced from an imaginary reference surface and defining an intersection region; and said at least two intersecting structures partially superposing one another in said intersection region and being formed with at least one through opening in said intersection region, said at least one through opening including at least one slot.

12. The honeycomb body according to claim 11, wherein said at least one through opening is a plurality of through openings including at least two slots intersecting at a given angle.

13. The honeycomb body according to claim 11, wherein said at least one through opening is at least one perforation.

14. The honeycomb body according to claim 11, wherein said at least two intersecting structures superpose one another at a given angle in said intersection region.

15. The honeycomb body according to claim 11, wherein:

said at least two intersecting structures have, in said intersection region, respective heights with respect to the imaginary reference surface;

said at least two intersecting structures have, in said intersection region, a region of a common theoretical maximum height with respect to the imaginary reference surface, the common theoretical maximum height is greater than at least one of the respective heights;

said at least one through opening is provided in said region of the common theoretical maximum height; and said at least one through opening has an edge spaced from the imaginary reference surface by a given spacing distance, the given spacing distance being smaller than the common theoretical maximum height.

16. The honeycomb body according to claim 11, wherein said at least two intersecting structures are substantially wave-shaped structures.

17. The honeycomb body according to claim 11, wherein at least one of said at least two intersecting structures has a substantially V-shaped cross-section.

18. The honeycomb body according to claim 11, wherein at least one of said at least two intersecting structures is a primary structure having a first amplitude and at least one of said at least two intersecting structures is a secondary structure having a second amplitude, and said first amplitude is greater than said second amplitude.

19. The honeycomb body according to claim 11, wherein said at least two intersecting structures are a plurality of structures including a primary structure having a first amplitude and including at least two secondary structures having respective second amplitudes, said first amplitude is greater than said second amplitudes, and said at least two secondary structures superpose one another on said first structure.

20. The honeycomb body according to claim 11, wherein said at least two intersecting structures are a plurality of structures including a primary structure having a first amplitude and including at least two secondary structures having respective second amplitudes, said first amplitude is greater than said second amplitudes, said primary structure has a wave crest, and said at least two secondary structures superpose one another on said wave crest.

21. The honeycomb body according to claim 11, wherein said at least two intersecting structures are a plurality of structures including a primary structure having a first amplitude and including at least two secondary structures having respective second amplitudes, said first amplitude is greater than said second amplitudes, said primary structure has a wave trough, and said at least two secondary structures superpose one another in said wave trough.

22. The honeycomb body according to claim 11, wherein said at least one flat construction includes alternating layers of smooth configurations and structured configurations, said structured configurations have a primary structure and a secondary structure.

23. The honeycomb body according to claim 11, wherein said at least one flat construction includes alternating layers of smooth configurations and structured configurations, and said smooth configurations have a primary structure.

24. The honeycomb body according to claims 11, wherein said at least one flat construction is an at least partially metallic construction.

25. The honeycomb body according to claim 11, wherein said at least one flat construction is a metal foil.

* * * * *